United States Patent [19]

Everett et al.

[11] 4,366,436

[45] Dec. 28, 1982

[54] ENGINE ANALYZERS

[75] Inventors: Geoffrey J. Everett, Somerton; Christopher J. Hunt, Tiverton, both of England

[73] Assignee: TI Crypton Limited, Bridgewater, England

[21] Appl. No.: 210,344

[22] Filed: Nov. 25, 1980

[30] Foreign Application Priority Data

Nov. 27, 1979 [GB] United Kingdom ..... 7940836

[51] Int. Cl.[3] ..... F02P 17/00

[52] U.S. Cl. ..... 324/379

[58] Field of Search ..... 324/379, 394, 402

[56] References Cited

U.S. PATENT DOCUMENTS

| | | | |
|---|---|---|---|
| 2,645,751 | 7/1953 | Byerlay | 324/379 X |
| 2,791,745 | 5/1957 | Ramsay | 324/379 |
| 3,175,149 | 3/1965 | Whaley | 324/394 |
| 3,221,545 | 12/1965 | Traver | 324/379 X |
| 3,409,824 | 11/1968 | Makuh | 324/379 |
| 3,619,767 | 11/1971 | Pelta et al. | 324/379 X |
| 3,714,499 | 1/1973 | Pelta et al. | 324/379 X |
| 3,798,965 | 3/1974 | Pelta et al. | 324/379 X |

*Primary Examiner*—Stanley T. Krawczewicz

*Attorney, Agent, or Firm*—Kemon & Estabrook

[57] ABSTRACT

An engine analyzer including a plurality of probes each connectable to one component of a different pair from a plurality of pairs of engine components, each pair comprising a spark plug and a lead connected direct to said spark plug, in which each probe will emit a succession of pulses during use, some or all of the pulses being of either one polarity or of the opposite polarity, wherein the invention comprises means to process said pulses and to emit coincident pulses all of one predetermined polarity, irrespective of the polarity of the pulses from the probe.

6 Claims, 10 Drawing Figures

PRIOR ART

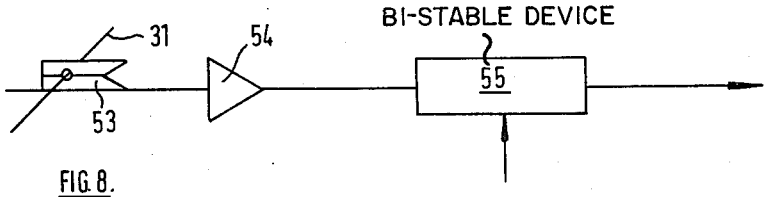
FIG. 8.
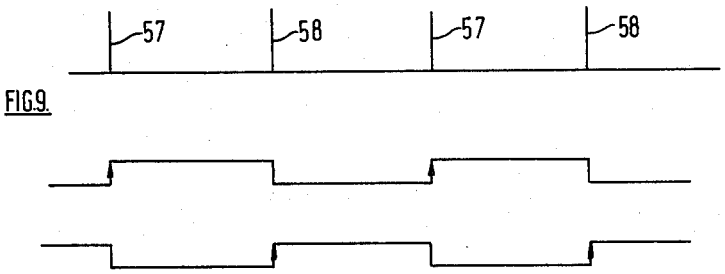
FIG.9.
FIG.10.
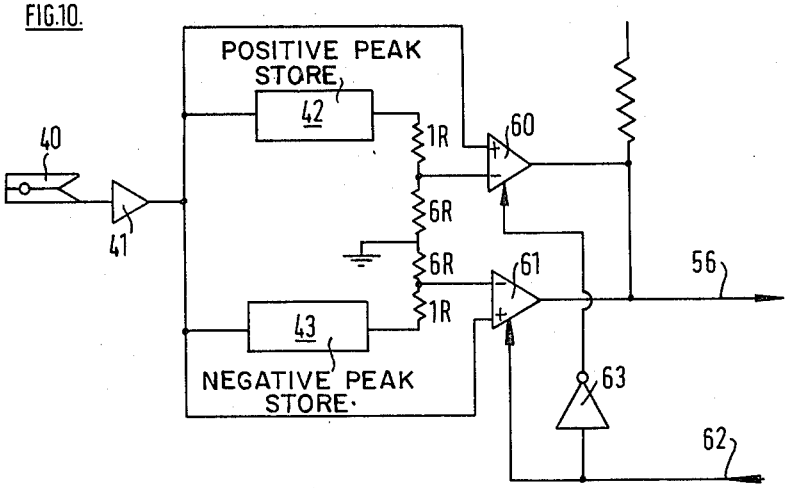

ENGINE ANALYZERS

This invention relates to engine analysers for spark ignition internal combustion engines.

According to the invention, an engine analyser includes a plurality of probes, each adapted to derive an input signal for the analyser from a different spark plug of the engine or lead feeding that spark plug and in which one or more probes will emit a succession of pulses during use, some or all of the pulses being of either one polarity or of the opposite polarity and including means to process said pulses and to emit coincident pulses all of a predetermined polarity, irrespective of the polarity of the pulses from the probe.

Preferably each probe feeds a positive peak store and a negative peak store connected in parallel and connected to feed a common input of a comparator of selected polarity, the output of the comparator being connected to the input of an invertor arranged to invert pulses passing through it only when fed by a pulse from the comparator, and a feed to the invertor from the probe in parallel with the peak store, whereby the invertor will pass pulses from the probe which are of opposite polarity to said selected polarity and will invert pulses from the probe which are of said selected polarity so that all the pulses emitted by the invertor will be of polarity opposite to said selected polarity. Conveniently there is provided at least one probe for each of said spark plugs or spark plug leads.

According to a feature of the invention the engine analyser may include comparator means arranged to compare the magnitude of any pulses received simultaneously from the probes and to transmit only the pulse of greatest magnitude at that time. The pulse from the probes may be converted to the same predetermined polarity and fed through a parallel array of diodes, one for each probe, to a common point, whereby the diode passing the pulse of greatest magnitude will inhibit simultaneous conduction of the other diodes.

According to another feature of the invention, the engine analyser may include rejection means arranged to inhibit passage of those pulses from said one probe which do not reach a predetermined magnitude. Preferably the predetermined magnitude is a predetermined percentage of the magnitude of and less than the previous pulse.

Figure 1:
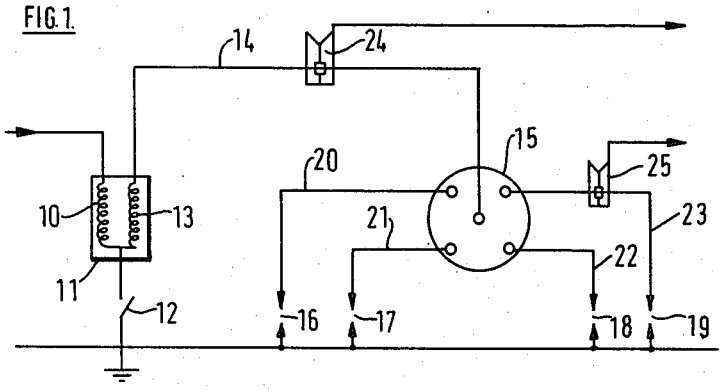
PRIOR ART FIG. 1.
Figure 2:
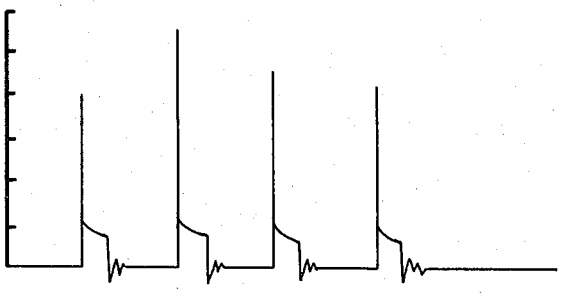
PRIOR ART FIG. 2.
Figure 3:
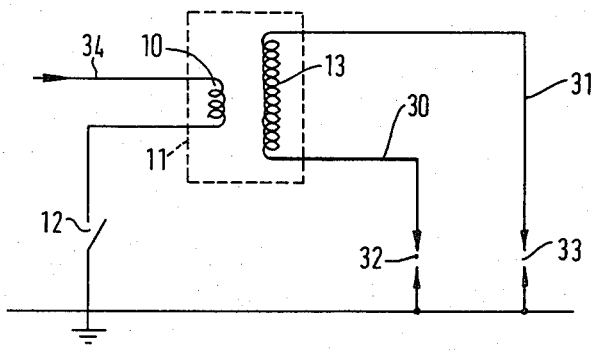
PRIOR ART FIG. 3.
Figure 4:
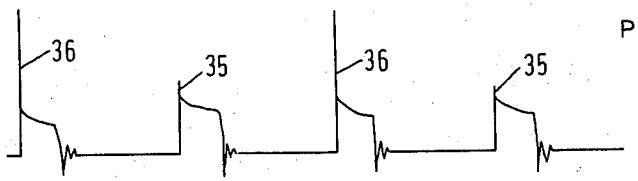
Figure 5:
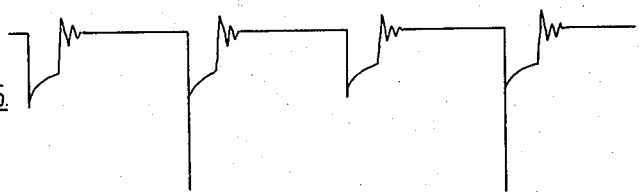
PRIOR ART FIG. 5.
Figure 6:
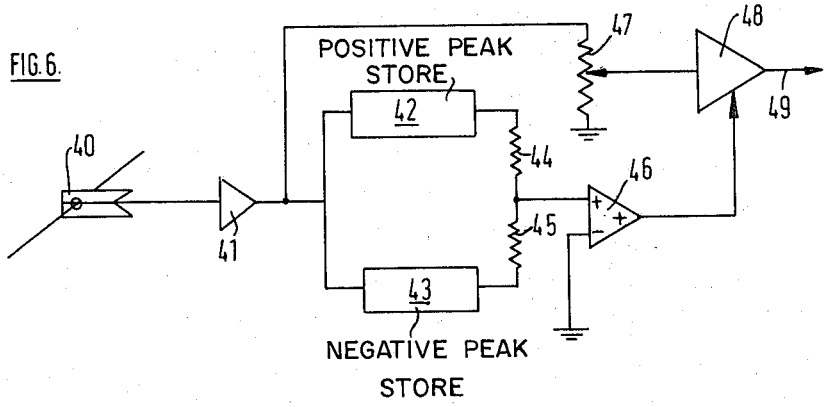
Figure 7:
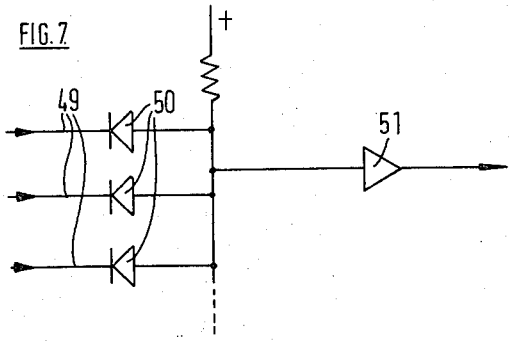

The invention is described, by way of example only, with reference to the accompanying drawings, in which:

FIG. 1 is a circuit diagram of part of a conventional spark ignition circuit for a 4 cylinder, 4 stroke internal combustion engine, FIG. 2 is a display of ignition voltage against time occurring in part of FIG. 1, FIG. 3 is a circuit diagram of part of a spark ignition circuit for a 2 cylinder, 4 stroke internal combustion engine, FIG. 4 is a display of ignition voltage against time occurring in part of FIG. 3, FIG. 5 is a display of ignition voltage against time occurring in another part of FIG. 3, FIG. 6 is a circuit diagram of part of an engine analyser, according to the invention, adapted to process the voltages shown in FIG. 4 or FIG. 5, FIG. 7 is a circuit diagram of another part of the engine analyser, FIG. 8 is a circuit diagram of a further part of the engine analyser, FIG. 9 is a display of voltages occurring in FIG. 8, FIG. 10 is a further circuit diagram of part of the engine analyser.

FIG. 1 shows, in diagramatic form, part of the ignition system of a typical 4-cylinder spark ignition engine. Current through the low-voltage winding (10) of the ignition coil (11) is interrupted at appropriate times by a contact-breaker (12) to induce high-voltage ignition pulses in the secondary winding (13) of the coil (11). These pulses are conducted by a "King" lead (14) to a distributor (15), in known way. Each of the cylinders of the engine is fitted with a sparking plug (16), (17), (18), (19), through leads (20), (21), (22), (23).

By inspecting, comparing and possibly utilising the high-voltage pulses fed in turn to the sparking plugs (16), (17), (18), (19), the condition of the ignition system and of the rest of the engine can be deduced. FIG. 2 shows a typical "parade" of the voltages applied to the sparking plugs, in which voltage is shown vertically against time horizontally, typically on a cathode ray oscilloscope. Often, a comparison of the relative heights of the voltage pulses is more important than their absolute values.

To achieve these known results it is known to reproduce the stream of pulses passing along the King lead (14), by means of a capacitive probe (24), clipped on the King lead (14). To synchronize the trace shown in FIG. 2, so that the first pulse is always, say, from No. 1 cylinder, it is known to take a synchronizing pulse from the lead (23) by means of another capacitive or inductive probe (25).

However, the type of ignition system described so far is not always used and FIG. 3 shows, again in diagramatic form, part of the ignition system commonly used on 2-cylinder engines, for example in some motor cars and on motor cycles. For engines having 4 or 6 cylinders, the circuit of FIG. 3 is duplicated or triplicated. For engines having more cylinders one circuit is added for each extra pair of cylinders. Although FIG. 3 shows the coil (11) and contact-breaker (12), there is no distributor (15). The secondary winding (13) is connected at each end with a high-voltage lead (30), (31), leading to respective sparking plugs (32), (33). Whereas in FIG. 1 the contact-breaker (12) operates normally at half engine rotation speed, in FIG. 3 it operates at engine rotation speed, so that each time a spark is produced at the correct time for ignition of a charge in one of the cylinders there will also be produced, at the same instant, a spark in the other cylinder at the end of the exhaust stroke and beginning of the induction stroke, on a 4-stroke cycle engine. The spark required for ignition is designated the "real" spark and the coincident spark in the other cylinder is called the "wasted" spark. It will be seen that the pulses in lead (31) will always be positive relative to earth and the pulses in lead (30) will always be negative relative to earth, or vice versa, depending on the polarity of the lead (34).

It will be seen that in this type of ignition system there is no King lead (14) along which all the ignition pulses pass. Therefore, it is necessary to affix a separate capacitive probe to each lead (30), (31), and in some way to combine the signals from both leads (30), (31), to generate a parade of the type shown in FIG. 2.

FIG. 4 shows a plot of voltage against time of the voltage in lead (31). It will be seen that due to the lower pressure in the cylinder during the wasted spark, the peak voltages of the wasted sparks (35), are lower than those of the real sparks (36).

FIG. 5 shows the voltage pattern in the lead (30), starting at the same time as FIG. 4. It will be seen that the pulses are all negative relative to earth in FIG. 5, whereas in FIG. 4 they are all positive. It will also be seen that in FIG. 5 each wasted spark coincides with a real spark of FIG. 4.

The first requirement is to invert the pulses of either FIG. 4 or FIG. 5, so that they can all be displayed in the same sense and thus be directly compared, as in FIG. 2. As mentioned above, for each lead of the 2 or more cylinders there is provided a preferably capacitive probe (40), in FIG. 6.

For each probe (40) there is provided a circuit of the type shown in FIG. 6, comprising a buffer amplifier (41), feeding a positive peak store (42) and a negative peak store (43), arranged in parallel. The outputs of the peak stores (42), (43), combine through resistors (44), (45), to feed the positive input of a comparator (46), which is arranged to emit a signal only when the input peaks are positive.

The output signal from the buffer amplifier (41) feeds, through a scaling potentiometer (47), to the input of an inverting amplifier (48), which only inverts the pulses when it is fed by a signal from the comparator (46). Therefore, when the pulses are negative the comparator (46) emits no signal, so that the pulses pass straight through the invertor (48). On the other hand, when the pulses are positive, the comparator (46) will emit a signal which will cause the invertor (48) to invert the positive input pulses and emit negative output pulses.

It will be seen that the outputs of all the invertors (48) will always be negative pulses, which could be superimposed on a time base to give a parade of the pulses to all the cylinders, as in FIG. 2. However, if the pulses in FIG. 4 are inverted and super-imposed on the pulses of FIG. 5, the pulse of each real spark will be added to the pulse of a wasted spark at the same time. FIG. 7 shows a circuit for eliminating the wasted spark pulses, so that only the real spark pulses constitute the parade. In FIG. 7 each output (49) from each invertor (48) feeds through a diode (50), before joining at the input of a further amplifier (51). Thus, a real spark pulse passing through one of the diodes (50) will inhibit conduction of any diode (50) which is fed with a wasted spark pulse. The amplifier (51) will, therefore, only emit the real spark pulses, to constitute the vertical voltages of the parade.

The horizontal sweep voltages are generated within the cathode ray equipment, in the usual way, but are triggered from No. 1 cylinder. For synchronization purposes the wave form of the current in the lead (31) is more reliable than the voltage wave form. Therefore, whereas a capacitive probe is generally used to derive the voltage pattern, an extra probe (53) in FIG. 8, of inductive type, is attached to the No. 1 cylinder lead (31). The pulses from the probe (53) are fed through a buffer amplifer (54) and through a bi-stable device (55). The positive edge of the bi-stable output is used to initiate the horizontal sweep.

FIG. 9 shows that without a synchronising pulse applied to the control input (56) of the bi-stable device (55), two timing sequences are possible, one with the trace synchronised to the real spark pulses (57) and the other synchronised to the wasted spark pulses (58).

FIG. 10 shows a synchronisation circuit which is fed from the capacitive probe (40) on the lead to No. 1 sparking plug only. The amplifer (41) and peak stores (42) and (43), are those used in FIG. 6. Further outputs from the stores (42), (43) are fed through voltage-dividing resistors, as shown in FIG. 10, to feed 2 further comparators (60), (61). The output signal from the comparator (46) is fed along line (62) to the comparator (61), and also through an invertor (63) to the comparator (60). The signal in line (62) is used to inhibit the comparator (61), when the input signal is positive. The inverted signal from invertor (63) is used to inhibit the comparator (60) when the input signal is negative.

If the signal from the probe (40) comprises a train of positive pulses, as in FIG. 4, the positive peak detector (42) will hold to the maximum value of the real spark. 80% of this value is applied to the comparator (60) as a reference. Thus only real spark signals will give synchronisation pulses along line (56), since wasted spark voltages will generally be below the reference amplitude. The actual value of the percentage selected depends on the relative values of the real and wasted sparks.

The real spark synchronizing pulses can be used for other purposes e.g. measuring spark advance angle by comparison with a crankshaft position generated pulse.

At low engine speeds, i.e. less than 2,000 r.p.m., the real spark is significantly greater than the wasted spark. Above this speed real and wasted sparks may become of comparable amplitude under certain engine conditions.

To ensure that this is not a problem the synchronisation circuit is only allowed to operate below engine speeds of 2,000 r.p.m., for example by using a tachometer range change relay (unshown) as a switch.

The analyser described above may be adapted for use on distributorless engine ignition equipment, such as certain transistorised types, where the circuit is enclosed in a box of which the only output comprises the leads to the spark plugs, i.e. there is no single output lead along which all of the ignition pulses pass.

Although the invention has been described with reference to a four stroke engine it is equally useful for analysing the performance of multi-cylinder two stroke cycle engines. It is particularly useful for analysing the kind in which an ignition spark occurs twice at each spark plug at each revolution of the engine. In each cylinder one of the sparks occurs near top dead centre and the next spark occurs near bottom dead centre, so that the latter alternate sparks occur near the end of the power stroke. The analyser described above for a four stroke cycle engine is thus able to display all of the voltage signals intended to ignite mixture in the cylinders but not to display voltage signals associated with the said alternate sparks, which occur near the end of the power strokes.

Instead of displaying the magnitude of the voltage pulses on a cathode ray oscillosope, the information can be presented in any other appropriate manner, for example on one or more meters, a visual display unit, histogram display, digital display, etc.

The construction of the capacitive probe (24), inductive probe (25), buffer amplifier (41), peak stores (42), (43), comparators (46), (60) and (61), invertors (48) and (63), diode (50), amplifier (51), bi-stable device (55) are all well known to those skilled in the art and need not be described further.

Instead of displaying the ignition voltage traces of two or more cylinders at the same time on the oscilloscope it is occasionally required to display the whole voltage trace of a selected cylinder over the whole of its working cycle and then to be able to switch the analyser to display whole voltage trace of a different cylinder for comparison. The analyser described above enables such a mode of working with the advantage that all of the successive displays are presented in the same polarity.

Although the use of the extra probe (53) has been described as providing more reliable synchronization, in some circumstances the signal from one of the capacitive probes (40), or from an extra capacitive probe (53) can be utilised.

We claim:

1. An engine analyser to analyse a parameter of a spark ignition internal combustion engine of the type having a plurality of pairs of ignition components, each component comprising a spark plug and a lead connected directly to said spark plug, and means for supplying high voltage pulses to said components at least some of the pulses being of opposite polarity, comprising:

a plurality of probes equal in number to the number of component pairs, each for connection to one component of a different one of said pairs to provide pulses corresponding to the ignition voltage or current pulses applied to the associated spark plug, there being at least one separate probe for each of said pairs; and means connected to each of said probes to process said pulses and emit further pulses each coincident with the original pulse but all of one predetermined polarity irrespective of the polarity of the pulses from the probe for display of said further pulses.

2. An engine analyser, as in claim 1, including rejection means arranged to inhibit passage of those pulses from said probes which do not reach a predetermined magnitude.

3. An engine analyser, as in claim 2, in which the predetermined magnitude is a predetermined percentage of the magnitude of and less than the previous pulse.

4. An engine analyser as defined in claim 1 including a pair of peak stores corresponding to and connected to each of said probes respectively, each pair of stores comprising a positive peak store and a negative peak store connected in parallel, a comparator of selected polarity, each of said pairs of peak stores being connected to feed a common input of said comparator, an inverter connected to said comparator to invert pulses passing through it only when fed by a pulse from the comparator, and a feed connected to the inverter and the probe in parallel with said peak store, whereby, the inverter will pass pulses from the probe which are of opposite polarity to said selected polarity and will invert pulses from the probe which are of said selected polarity so that all of the pulses emitted by the inverter will be of polarity opposite to said selected polarity.

5. An engine analyser to analyse a parameter of a spark ignition internal combustion engine of the type having a plurality of paris of ignition components, each component comprising a spark plug and a lead connected directly to said spark plug and means for supplying high voltage pulses to said components, at least some of the pulses being of opposite polarity, comprising:

a plurality of probes equal in number to the number of component pairs, each for connection to one component of a different one of said pairs to provide pulses corresponding to the ignition voltage or current pulses applied to the associated spark plug, there being at least one separate probe for each of said pairs;

means connected to each of said probes for processing said pulses and emit coincident pulses all of one predetermined polarity, irrespective of the polarity of the pulses from the probe, said means including comparator means connected to compare the magnitude of any pulses received simultaneously from the probes and to transmit only the pulse of greatest magnitude at that time.

6. An engine analyser as defined by claim 5 including means including a parallel array of diodes, one for each probe and connected to feed said converted pulses to a common point whereby the diode passing the pulse of greatest magnitude will inhibit simultaneous conduction of the other diodes.

* * * * *